US006436106B2

(12) United States Patent
Yiu

(10) Patent No.: US 6,436,106 B2
(45) Date of Patent: Aug. 20, 2002

(54) HAIR REMOVAL DEVICE WITH DISC, VIBRATION, AND LIGHT ASSEMBLIES

(75) Inventor: Wai-Wah Yiu, Kowloon (HK)

(73) Assignee: Soft Lines, Ltd., Hong Kong (CN)

( * ) Notice: Subject to any disclaimer, the term of this patent is extended or adjusted under 35 U.S.C. 154(b) by 0 days.

(21) Appl. No.: 09/750,396

(22) Filed: Dec. 28, 2000

Related U.S. Application Data

(63) Continuation-in-part of application No. 09/669,378, filed on Sep. 26, 2000, which is a continuation-in-part of application No. 09/246,454, filed on Feb. 9, 1999, now Pat. No. 6,123,713, which is a continuation-in-part of application No. 09/112,971, filed on Jul. 9, 1998, now Pat. No. 5,976,157.

(51) Int. Cl.[7] ..... A61B 17/50
(52) U.S. Cl. ..... 606/133
(58) Field of Search ..... 606/9–18, 131–134; 425/71–102

(56) References Cited

U.S. PATENT DOCUMENTS

| | | | | |
|---|---|---|---|---|
| 853,096 A | | 5/1907 | Lewis | |
| 1,071,978 A | | 9/1913 | White | |
| 2,417,530 A | | 3/1947 | Weiser | |
| 2,888,927 A | | 6/1959 | Fozard | |
| 2,894,512 A | | 7/1959 | Tapper | |
| 3,054,405 A | | 9/1962 | Tapper | |
| 3,088,470 A | | 5/1963 | Hall | |
| 4,174,713 A | | 11/1979 | Mehl | |
| 4,274,413 A | | 6/1981 | Hahn et al. | |
| 5,057,116 A | | 10/1991 | Zucker | |
| 5,100,414 A | | 3/1992 | Dolev | |
| 5,163,288 A | | 11/1992 | Doley | |
| 5,226,907 A | | 7/1993 | Tankovich | |
| 5,230,303 A | | 7/1993 | Rubino | |
| 5,281,233 A | | 1/1994 | Dolev | |
| 5,419,344 A | | 5/1995 | DeWitt | |
| 5,425,728 A | | 6/1995 | Tankovich | |
| 5,507,753 A | | 4/1996 | Iwasaki et al. | |
| 5,595,568 A | | 1/1997 | Anderson et al. | |
| 5,630,811 A | | 5/1997 | Miller | |
| 6,067,714 A | | 5/2000 | Taylor et al. | |
| 6,123,713 A | * | 9/2000 | Yiu et al. | 606/133 |
| 6,165,182 A | * | 12/2000 | Caric et al. | 606/133 |

* cited by examiner

*Primary Examiner*—Kevin T. Truong
(74) *Attorney, Agent, or Firm*—Pennie & Edmonds LLP

(57) ABSTRACT

A device for removing unwanted hair, including a hair-plucking assembly, a vibration assembly, a driving assembly, and a housing. The hair-plucking assembly includes at least two groups of disc assemblies that remove hairs as they rotate. In an alternative embodiment, disc assemblies are arranged in at least two rows, where disc assemblies arranged in one row rotate in an opposite direction to disc assemblies arranged in another row. As the hair-plucking assembly removes hair, the vibration assembly vibrates to massage the area of hair removal to minimize discomfort associated with the hair removal. In addition, an illumination mechanism may be added to the hair removal device to illuminate the hair removal area so as to help the user see the progress of hair removal.

20 Claims, 10 Drawing Sheets

HAIR REMOVAL DEVICE WITH DISC, VIBRATION, AND LIGHT ASSEMBLIES

This is a continuation-in-part of application Ser. No. 09/669,378, filed Sep. 26, 2000 now pending , which is itself a continuation-in-part of application Ser. No. 09/246,454, filed Feb. 9, 1999 and issued on Sep. 26, 2000 as U.S. Pat. No. 6,123,713, which is itself a continuation-in-part of application Ser. No. 09/112,971, filed Jul. 9 ,1998 and issued Nov. 2, 1999 as U.S. Pat. No. 5,976,157.

FIELD OF THE INVENTION

The present invention relates generally to a depilatory device for removal of unwanted hair, and more specifically, to a device for removing unwanted hair by trapping and uprooting the hair while at the same time massaging the hair-removal area to reduce discomfort associated with hair removal.

BACKGROUND OF THE INVENTION

There exists a need for removal of unwanted hair in order to maintain a desirable physical appearance. There are many devices known in the art that are useful for removing unwanted hair such as razors, tweezers and other depilatory devices. Although razors provide quick and easy hair removal, hair remains visible at the surface of the skin and quickly regrows. Therefore one must shave frequently in order to maintain smooth skin and a desired appearance.

On the other hand, tweezers provide longer-lasting hair removal than razors since, instead of merely cutting hair, tweezers remove the hair at its root. However, removing hair with tweezers is a tedious process since traditional tweezers can only remove one hair at a time and precise handling of the tweezers is required in order to position and grasp the hair between the two, usually small, opposing surfaces. Furthermore, care must be taken so that the hair is not inadvertently broken above the root leaving stubbles.

Other depilatory devices are known in the art such as one described in U.S. Pat. No. 5,281,233 to Dolev ("Dolev patent"). The Dolev hair removal device generally comprises a housing and a hair-plucking assembly rotatably mounted to the housing. The hair plucking assembly includes at least one disc assembly comprising (i) a pair of complementary discs, each of the discs having at least three radially extending arms terminating in flattened peripheral portions, which, when pressed against corresponding flattened peripheral portion of the arms of the other disc, form a trap for the hair; and (ii) a hub for accommodating and rotating the pair of discs so that the flattened peripheral portions of the discs are alternately brought together to form a trap to grasp the hair to be removed, and forced apart to eject the removed hair. The Dolev hair device, however, merely includes one row of disc assemblies, which limits the number of hairs it can remove at one time. Moreover, it lacks any mechanism for making the hair-removal process more comfortable for the user.

There is a need, therefore, for a depilatory device that is as easy and inexpensive to assemble and maintain as prior art devices but, at the same time, can easily uproot a greater number of hairs over a larger hair-removal area than is currently possible. In addition, there is also an ongoing need for depilatory devices that reduce discomfort associated with hair removal.

SUMMARY OF THE INVENTION

According to the present invention, the foregoing and other objects and advantages are attained by a hair removal device comprising a housing and a hair-plucking assembly. In preferred embodiments, the hair-removal assembly includes at least two groups of disc assemblies mounted within the housing. The disc assemblies may be arranged in at least two rows, which may be adjacent and/or parallel to one another. Disc assemblies arranged in a row may be rotationally fixed with respect to one another and may rotate together at a constant speed. In addition, disc assemblies arranged in one row may rotate in an opposite direction with respect to disc assemblies arranged in another row.

The disc assemblies may also be identical to one another. Each disc assembly may include an internal disc assembly and a pair of outer discs. Each internal disc may, in turn, comprise an insert disc having at least one arm and may be mounted on a disc carrier. Each outer disc may also have at least one arm and may be mounted on the internal disc assembly. The arm(s) of each outer disc may be pressed against the arm(s) of the internal disc to form traps for hair.

The disc carrier may further comprise at least one U-shaped member for engaging at least one arm of each of the pair of outer discs so as to impart rotational motion to the pair of outer discs upon rotation of the internal structure about an axis of the internal structure. The disc carrier may further comprise at least a pair of pinchers that extends axially from the U-shaped member(s) beyond the plane of the arm of each of the pair of outer discs for imparting a clamping force on at least one adjacent disc carrier. The disc carrier may further comprise engagement means for engaging at least one adjacent disc carrier so that rotational movement of one disc carrier imparts rotational motion to at least one adjacent disc carrier. The engagement means may comprise engagement protrusions and engagement recessions for engaging corresponding protrusions and recessions of at least one adjacent disc carrier. Finally, disc assemblies may be rotatably mounted on two shafts. The shafts may further be curved so that the disc assemblies are mounted in an inclined angle.

The hair removal device may further comprise an illumination mechanism that comprises a light source. Preferably, the light source may be an incandescent light bulb or an light-emitting diode located near the hair removal area for better lighting. In addition, the light source may be oriented at an angle to better illuminate the hair removal area. The illumination mechanism may further comprise a battery housing that houses a battery for supplying power to the light source. In the alternative, the illumination mechanism may draw power from the hair removal device for powering the light source. The illumination mechanism may be detachable from the hair removal device.

In accordance with another preferred embodiment of the invention, the hair removal device may comprise a housing, a hair-plucking assembly, and a vibration assembly mounted within the housing. The vibration assembly may comprise a vibration element to massage the hair removal area. This vibration element may be rotatably mounted on eccentric cylinders and may vibrate at a constant speed.

The housing may comprise brackets for mounting the hair-plucking assembly and vibration assembly to the housing. The vibration element may be located adjacent to the hair-plucking assembly and may act to move towards and away from the hair-plucking assembly. The vibration element may span at least the width of the hair-plucking assembly.

As discussed above, the hair-plucking assembly may comprise disc assemblies which are arranged in two rows, wherein the vibration element may be located between the rows of disc assemblies. The hair-plucking assembly and the vibration assembly may be powered by a driving assembly.

BRIEF DESCRIPTION OF THE DRAWINGS

For a more complete understanding of the present invention, reference is made to the following Detailed Description taken in conjunction with the accompanying drawings in which.

DETAILED DESCRIPTION OF THE PREFERRED EMBODIMENTS

Figure 2:
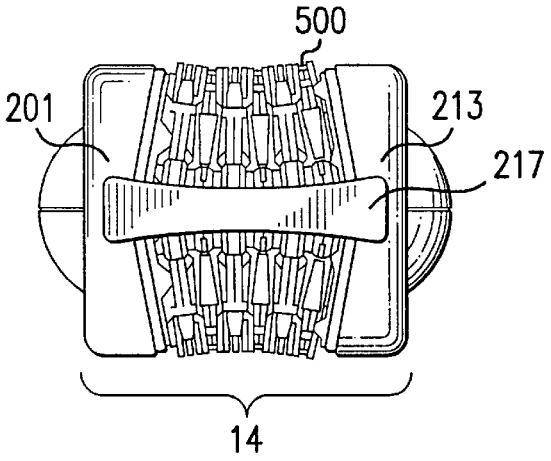
FIG. 2 is a top plan view of the hair remover of FIG. 1.
Figure 3:
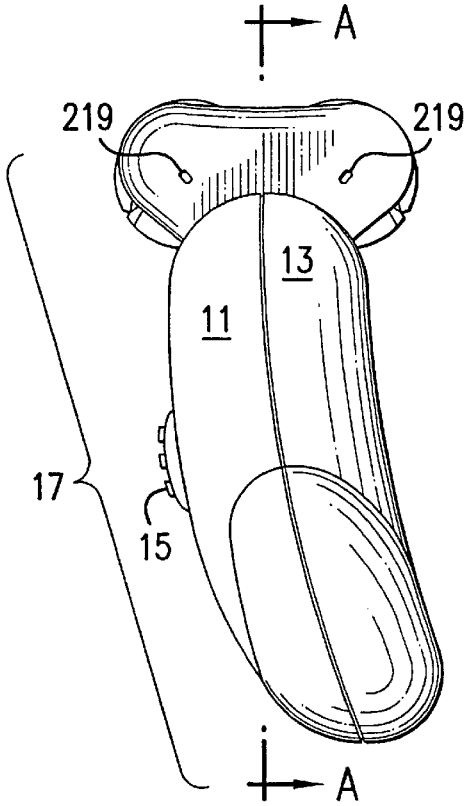
FIG. 3 is a side elevational view of the hair remover of FIG. 1.

FIGS. 1–12 illustrate a preferred embodiment of the hair removal device 10 according to the present invention. As shown in FIGS. 1–12, hair removal device 10 preferably includes a hair-plucking assembly 14 (FIGS. 1, 2), a vibration assembly 603 (FIG. 9), a driving assembly 216, 202–207 (FIGS. 4, 6), and a housing 17 (FIG. 3).

Figure 1:
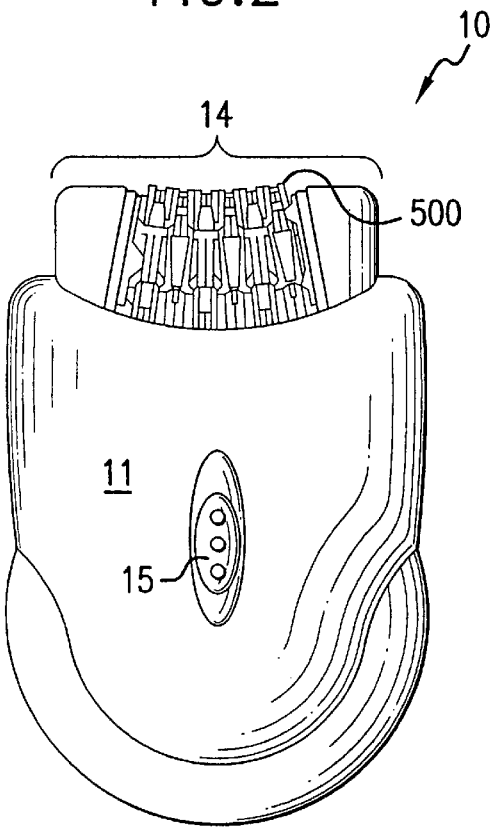
FIG. 1 is a front elevational view of a hair remover according to the invention.
Figure 7:
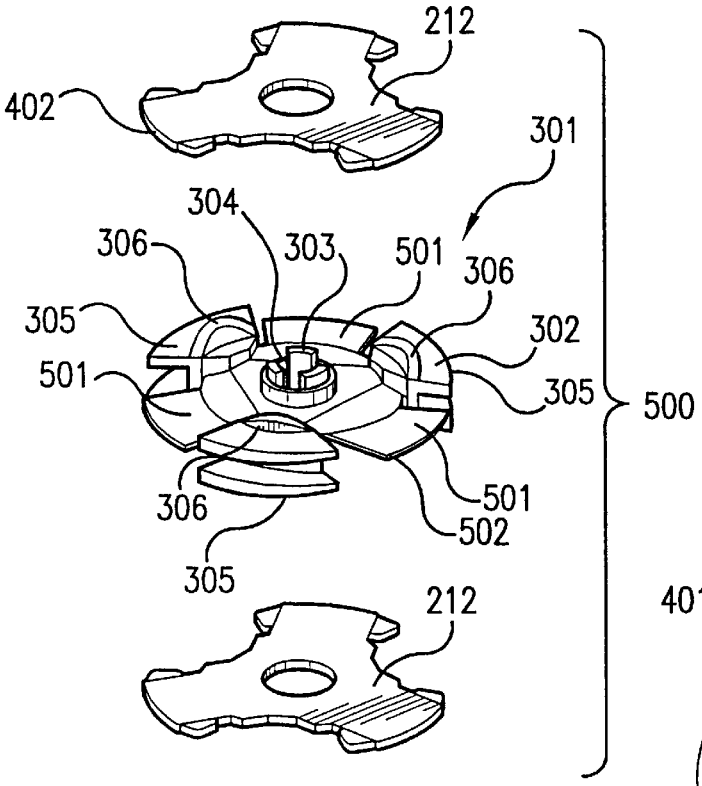
FIG. 7 is an exploded view of the outer discs and the internal disc assembly of the invention.

As shown in FIGS. 1–2, hair-plucking assembly 14 preferably includes, among other components described further below, a plurality of disc assemblies 500. A preferred embodiment of disc assembly 500 is illustrated in further detail in FIGS. 7–9. As shown in FIG. 7, each disc assembly 500 preferably includes three main elements: an internal disc assembly 301 and two outer discs 212. Each internal disc assembly 301 includes a disc carrier 302 and an insert disc 501. Each disc carrier 302, in turn, includes Ushaped members 305, opposing pinchers 306, engagement protrusions 303, and engagement recessions 304. Each insert disc 501 and outer disc 212 includes three radially extending arms oriented approximately 1200 apart with each arm terminating in flattened peripheral portions 502 and 402 respectively.

U-shaped members 305 of disc carrier 302 imparts rotational motion to outer discs 212. In addition, U-shaped members 305 serve as platforms for opposing pinchers 306, elevating opposing pinchers 306 out of the plane of radially extending arms 401 of outer disc 212 when outer disc 212 is mounted on internal disc assembly 301, as may be appreciated in FIG. 9. Opposing pinchers 306 exert pressure on flattened peripheral portions 402 of adjacent disc assemblies 500 in order to form traps for hair, as described in further detail below. Engagement protrusions 303 and engagement recessions 304 connect adjacent disc assemblies 500 together, as described in further detail below.

Figure 9:
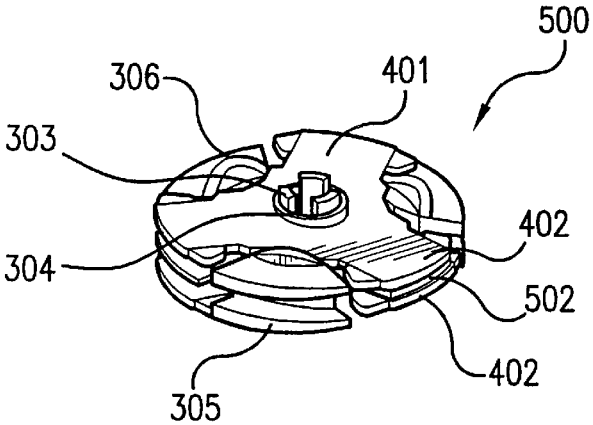
FIG. 9 is a perspective view of the disc assembly of FIG.7.

As illustrated in FIG. 7, the central portion of each outer disc 212 preferably includes a generally circular opening, which is sized and shaped so that each outer disc 212 may be mounted on internal disc assembly 301, as illustrated in FIG. 9. The configuration, i.e., dimensions and tolerances, of components 212, 303 of each disc assembly 500 is designed such that these components fit snugly together and remain engaged during operation of the device 10 (FIG. 1).

When outer discs 212 are mounted on internal disc assembly 301, flattened peripheral portions 402 of outer discs 212 are aligned with flattened peripheral portion 502 of internal disc assembly 301, so that when flattened peripheral portions 402 are pressed against the corresponding flattened peripheral portion 502, as illustrated in FIG. 9, traps that can grasp and hold hair are formed between flattened peripheral portion 502 and adjacent flattened peripheral portions 402.

It should be noted that, in alternative embodiments, disc assembly 500 may include one or two integral pieces having between them all the elements of the three components 212, 301, 212 discussed above. In addition, it should be noted that any hair-plucking disc assembly may be used, including the disc assembly described in Dolev's U.S. Pat. No. 5,281,233. We, therefore, incorporate by reference the disc assembly described in Dolev.

Figure 4:
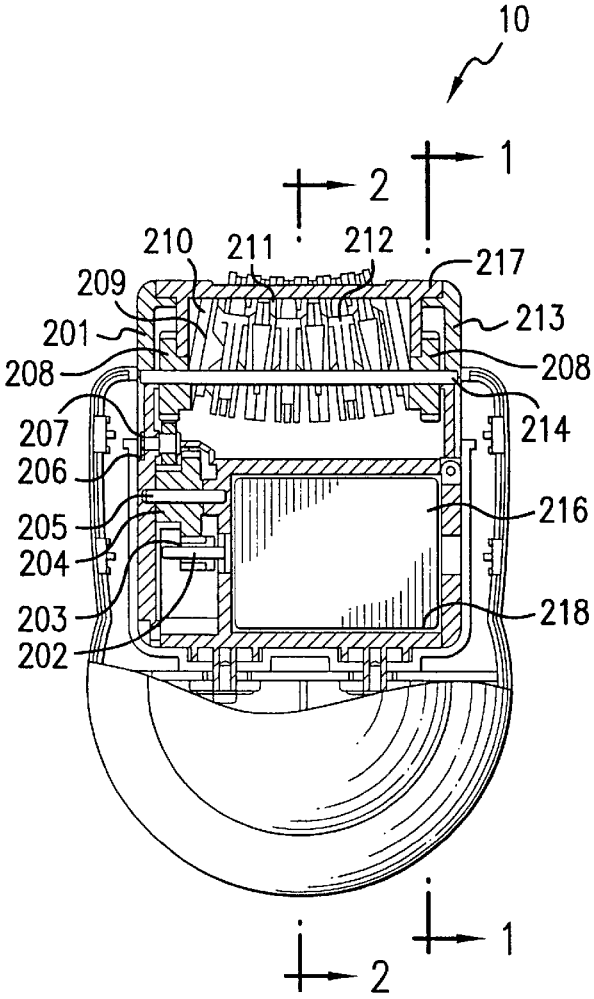
FIG. 4 is a front partial section view of the hair remover of FIG. 1 taken along line A—A of FIG. 3, featuring a number of disc assemblies.
Figure 5:
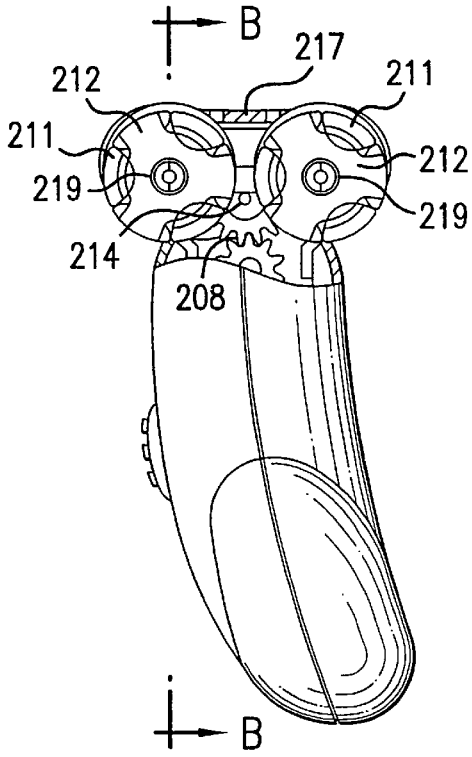
FIG. 5 is a side partial section view taken along line 2—2 of the hair remover of FIG. 4.
Figure 6:
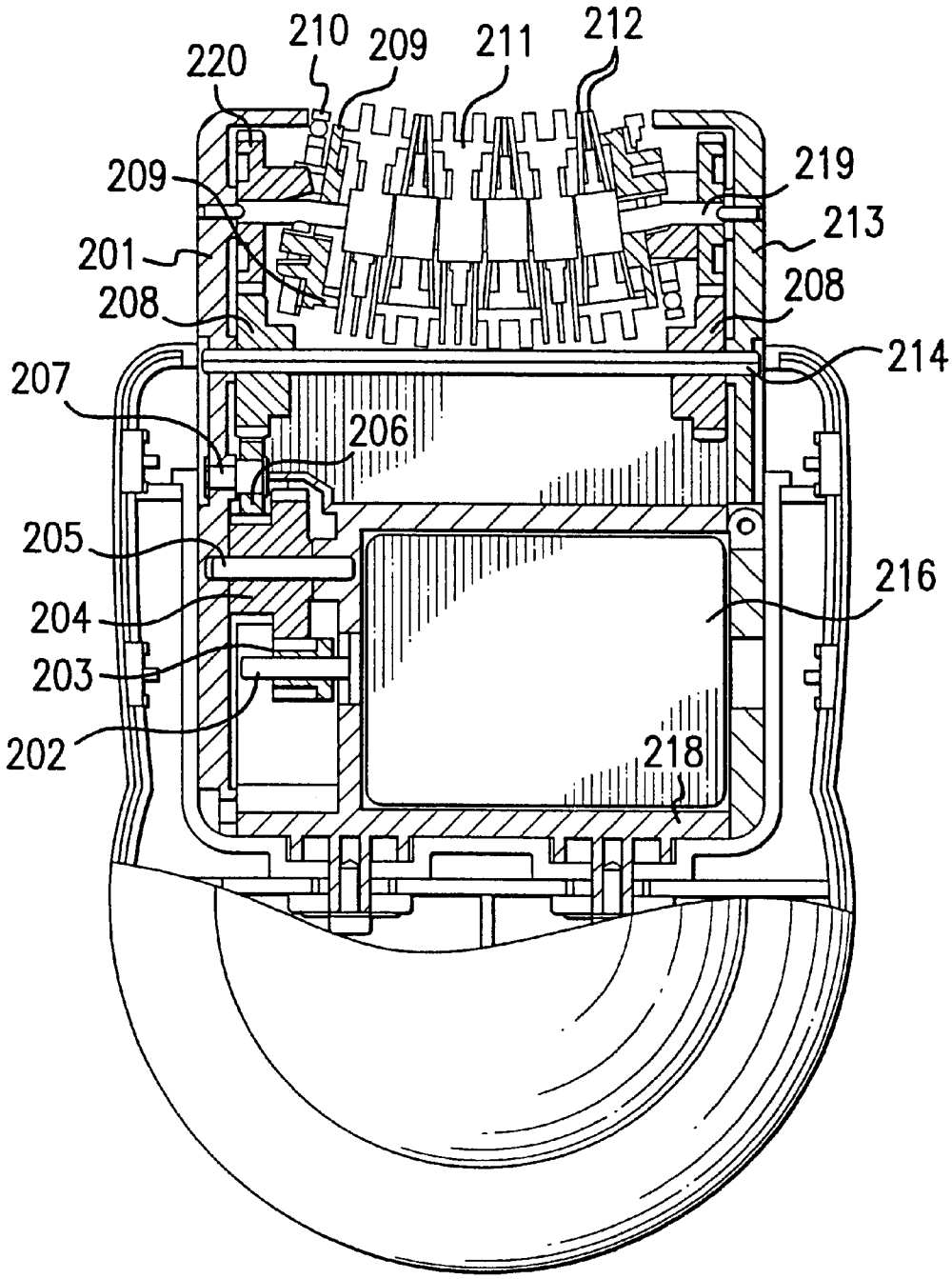
FIG. 6 is a front partial section view of the hair remover of FIG. 1 taken along line B—B of FIG. 5, featuring a number of disc assemblies.

As shown in FIGS. 4–6, in addition to a plurality of disc assemblies 500, hair-plucking assembly 14 also preferably includes shafts 219, bearings 210, bearing supports 209, and disc drive gears 220.

Shafts 219 are preferably curved for mounting disc assemblies 500. Mounting disc assemblies 500 on curved shafts 219 allows disc assemblies 500 to form traps for hair, as described in further detail below. Shafts 219 may be made of any appropriate material, including various rigid or flexible materials; however, appropriate support must be provided for curved shafts made of flexible material. Bearings 210 and bearing supports 209 transfer rotational force from disc drive gears 220 to disc assemblies 500 as well as ensure smooth rotation of disc assemblies 500. Disc drive gears 220 impart rotational motion to disc assemblies 500 through bearings 210 and bearing supports 209.

In the preferred embodiment illustrated in FIGS. 4–6, each disc assembly 500 is rotatably mounted on shafts 219, wherein each disc assembly 500 is engaged to adjacent disc assembly or assemblies 500 via engagement protrusions 303 and recessions 304. Specifically, each engagement protrusion 303 of one disc assembly 500 is inserted into an engagement recession 304 of an adjacent disc assembly 500 in a gear-like fashion. As a consequence of engaging disc assemblies 500, each disc assemblies 500 is angularly offset from adjacent disc assemblies 500 by 60° so that flattened peripheral portions 402 of a disc assembly 500 are aligned with opposing pinchers 306 of adjacent disc assemblies 500. Moreover, disc assemblies 500 engaged to one another are rotationally fixed with respect to one another so that they rotate in sync.

Bearings 210 and bearing supports 209 are placed between each end of each row of disc assemblies 500 and disc driving gears 220, respectively, to transfer rotation speed from disc driving gears 220 to hair-plucking assembly 14 as well as to facilitate smooth and steady rotation of disc assemblies 500. Disc driving gears 220 provide rotational motion to hair-plucking assembly 14.

Preferably, the portions of disc assembly 500 intended for contact with the hair are made of a metal material such as stainless steel, which is particularly effective for plucking hair, and the portions of disc assembly 500 which contact curved shafts 219 are made of plastic such as Acetal plastic to facilitate smooth rotation of the disc assembly 500. Alternatively, these components may be made up of other appropriate materials known in the art.

It should be noted that, although FIGS. 2 and 4 show that the preferred embodiment includes six disc assemblies 500 in each row of disc assemblies, in alternative embodiments, any number of disc assemblies 500 may be included in each row. In addition, it should be noted that shafts 219 need not be curved if the particular disc assemblies used do not require mounting in an inclined angle to best trap hair.

Figure 10:
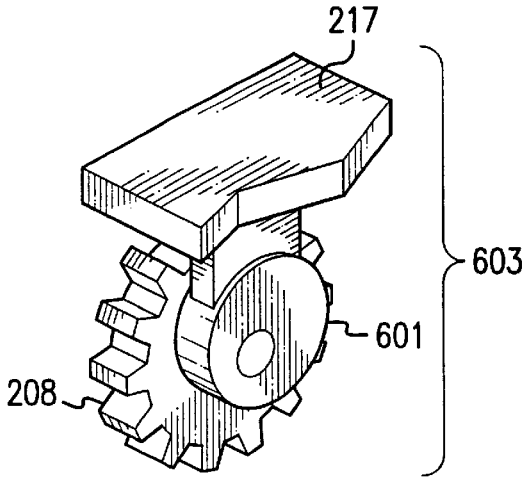
FIG. 10 is a perspective view of a vibration system in the hair remover of FIG. 1.
Figure 11:
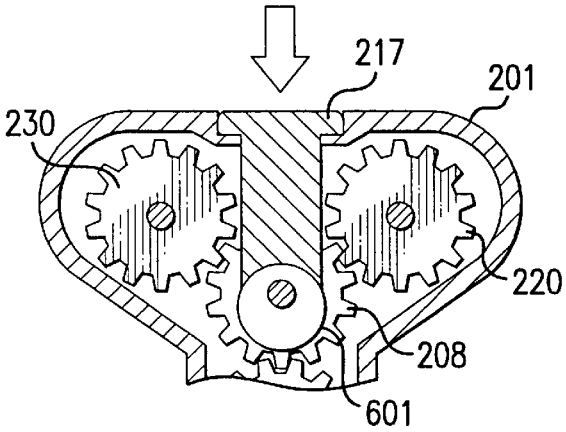
FIG. 11 is a side cross-sectional view taken along line 1—1 of FIG. 4 illustrating the vibration assembly with vibration element in a low position.
Figure 12:
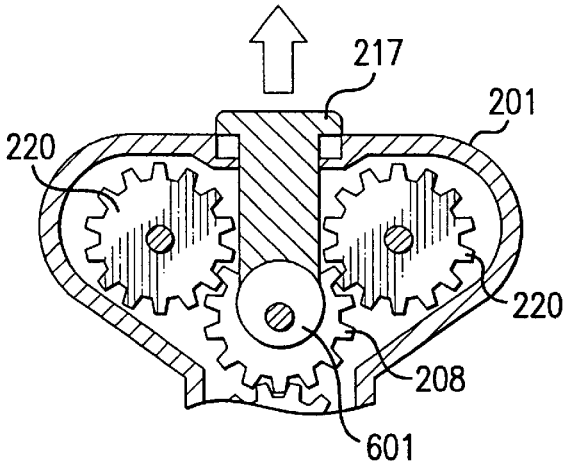
FIG. 12 is a side cross-sectional view similar to FIG. 10 of the vibration assembly with the vibration element in a high position.

Turning now to a preferred embodiment of vibration assembly 603 depicted in FIGS. 10–12, vibration assembly 603 includes a vibration element 217, vibration assembly gear 208, and eccentric cylinder 601. Vibration element 217 is rotatably mounted on eccentric cylinder 601, which are, in turn, fixed to vibration assembly gear 208. Vibration element 217 may be made of any hard and rigid material capable of withstanding all kinds of forces and scratches by vibration gear 208. Moreover, the surface of vibration element 217, which makes contact with the skin of the user, may be smooth or textured to provide various desired massage sensations. Mounting vibration element 217 on eccentric cylinder 601 allows vibration assembly gear 208 to impart motion to vibration element 217 as vibration assembly gears 208 rotate. This creates vibrations resulting in the massaging function of the present invention, as described in further detail below.

Turning now to a preferred embodiment of a driving assembly depicted in FIGS. 4 and 6, the driving assembly includes a motor 216, a motor shaft 202, a motor shaft gear 203, a reduction gear 204, a reduction gear shaft 205, a transmission gear 206, and a transmission gear shaft 207. Motor 216 drives both hair-plucking assembly 14 (FIG. 1) as well as vibration assembly 603 (FIG. 9) via reduction gear system 202–207, and can be any type of motor capable of imparting rotational motion to the reduction gear system 202–207. Motor 216 may be operated by any convenient and available power source such as a battery or house current via a DC adaptor. Motor shaft gear 203, reduction gear 204, and transmission gear 206 are mounted on motor shaft 202, reduction gear shaft 205, and transmission gear shaft 207 respectively. Motor shaft gear 203 is engaged with reduction gear 204, which is, in turn, engaged with transmission gear 206 to form a reduction gear system that converts the rotational speed imparted by motor 216 to a proper rotational speed to drive hair-plucking assembly 14 and vibration assembly 603.

Turning now to a preferred embodiment of housing 17 depicted in FIGS. 1–6, housing 17 preferably includes two cooperating housing halves 11, 13 (FIG. 3), brackets 201, 213 (FIGS. 2, 4, 6), motor housing 218 (FIGS. 4, 6), and power switch 15 (FIGS. 1, 3). Housing halves 11, 13 are ergonomically shaped to facilitate easy and comfortable gripping by one hand and is preferably constructed of plastic, although alternative materials may also be used. Brackets 201, 213 hold hair-plucking assembly 14 (FIG. 1) and vibration assembly 603 (FIG. 10) in place within housing 17. Similarly, motor housing 218 holds motor 216 and reduction gear system 202–207 in place within housing 17 for proper operation.

In operation, when a preferred embodiment of hair-removal device 10 as illustrated in FIG. 4 is turned on via on/off switch 15 (FIGS. 1, 3), motor 216 is activated and imparts rotational force to motor shaft 202, which, in turn, imparts rotational force to motor shaft gear 203. Motor shaft gear 203, in turn, drives reduction gear 204 which drives transmission gear 206. Transmission gear 206 then imparts rotational force to vibration gear 208. Vibration gear 208, in turn, drives disc drive gears 220.

Figure 8:
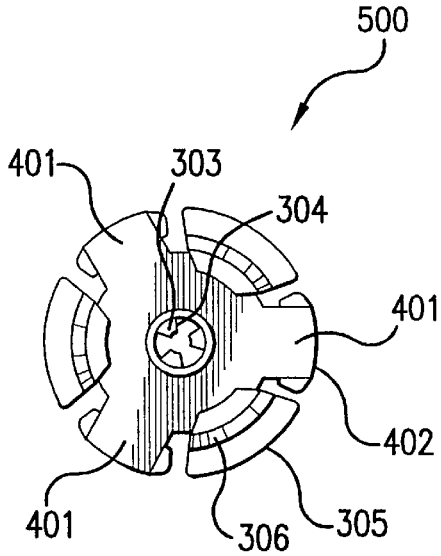
FIG. 8 is a plan view of the disc assembly of FIG. 6, such as might be used in the device of FIG. 1.

As disc drive gears 220 rotate, they drive bearings 210 and bearing supports 209. Bearings 210 and bearing supports 209, in turn, drive disc assemblies 500 (FIGS. 7–9). As was described above, the two rows of disc assemblies 500 are mounted on curved shafts 219 (FIGS. 3, 5, 6). This curvature results in disc assemblies 500 having little room between one another near the top of the hair removal device 10 so that disc assemblies 500 are actually compressed together at the top of the hair removal device 10. This compression of disc assemblies at the top of the hair removal device 10 creates traps for hair. Specifically, when disc assemblies 500 rotate, they are compressed, or push against one another, at the top of the hair removal device 10. As a result, opposing pinchers 306 mounted on U-shaped members 305 presses flattened peripheral portions 402 of adjacent disc assemblies 500 against their corresponding flattened peripheral portions 502, as illustrated in FIG. 7–9 Pressing flattened peripheral portions 402 against corresponding peripheral portions 502 forms traps for hair, as was described above and illustrated in FIG. 9.

While hair-plucking assembly 14 is driven by disc drive gears 220, vibration gear 208 drives vibration assembly 603, wherein eccentric cylinder 601 lifts and lowers the vibration element 217 rapidly, as vibration gear 208 rotates, in order to generate the massage function of the present invention. Specifically, when vibration gear 208 rotates to the position shown in FIG. 11, vibration beam 217 moves to a low position close to disc assemblies 500. When vibration gear 208 rotates to the position shown in FIG. 12, vibration beam 217 moves to a high position away from disc assemblies 500. Therefore, as vibration gear 208 rotates continuously, vibration beam 217 moves towards and away from disc assemblies 500 rapidly, creating vibrations that massage the hair removal area.

Figure 13:
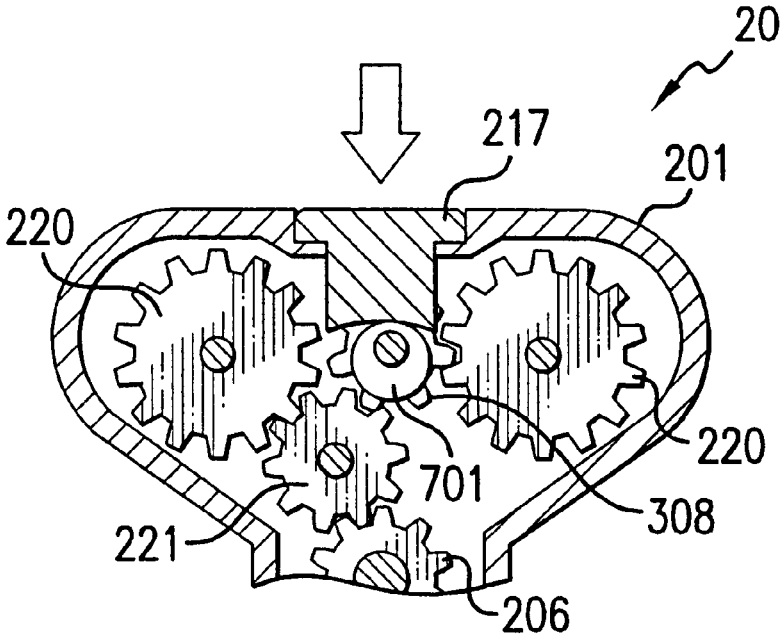
FIG. 13 is the same view as FIG. 11, but of an alternative embodiment with oppositely rotating disc assemblies.
Figure 14:
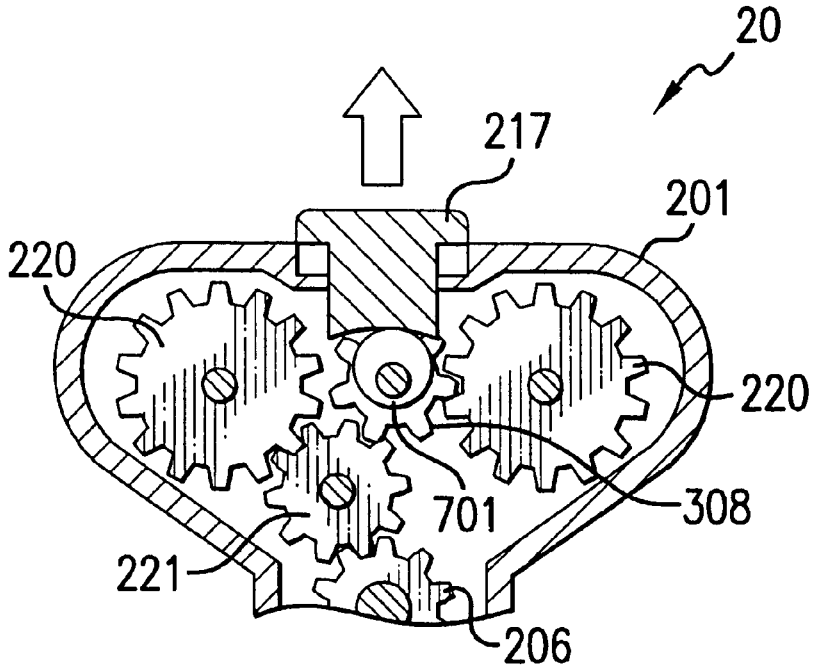
FIG. 14 is the same view as FIG. 12 of the alternative embodiment.
Figure 15:
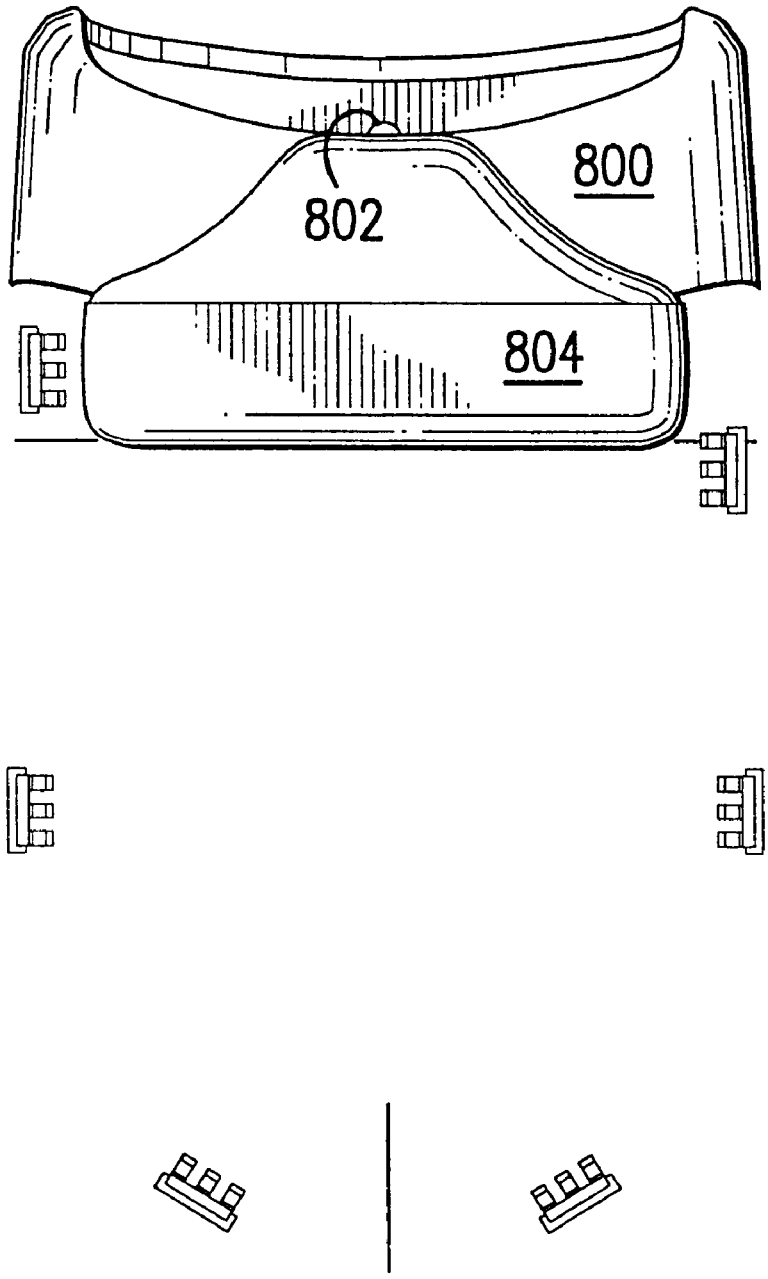
FIG. 15 is a front view of an illumination mechanism attached to a hair removal device.
Figure 16:
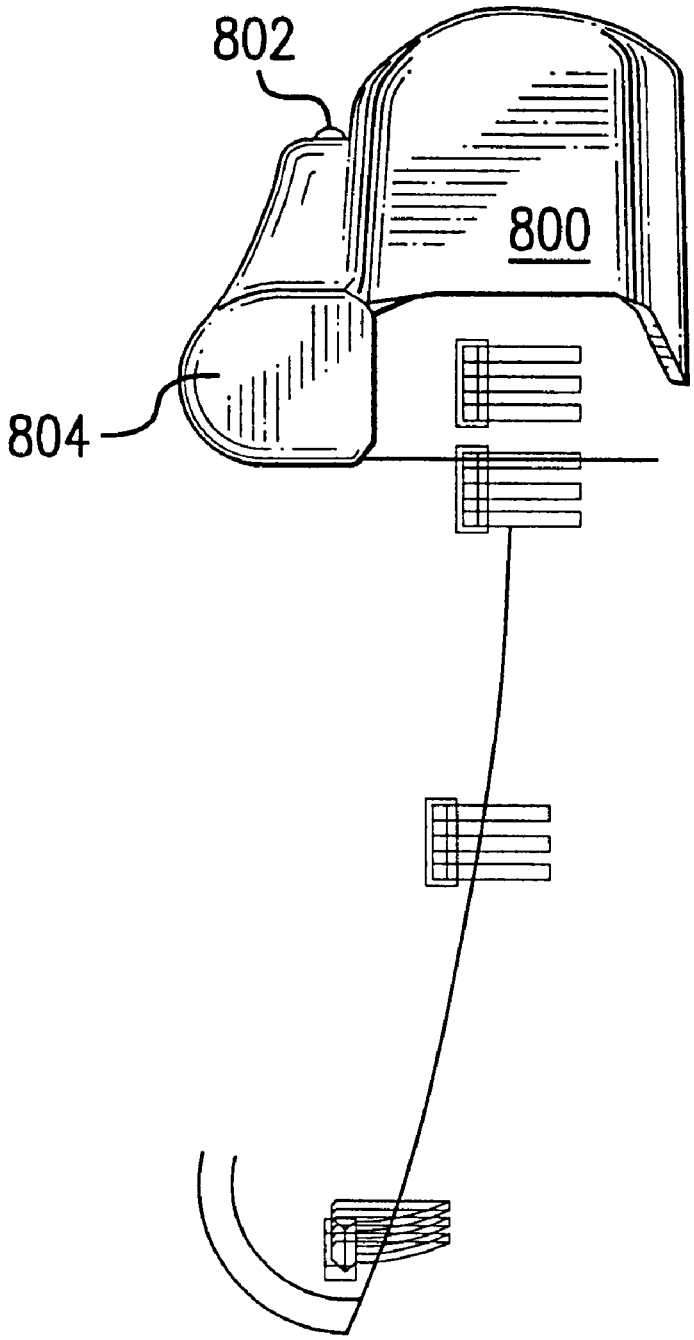
FIG. 16 is a side view of the illumination mechanism attached to a hair removal device.
Figure 17:
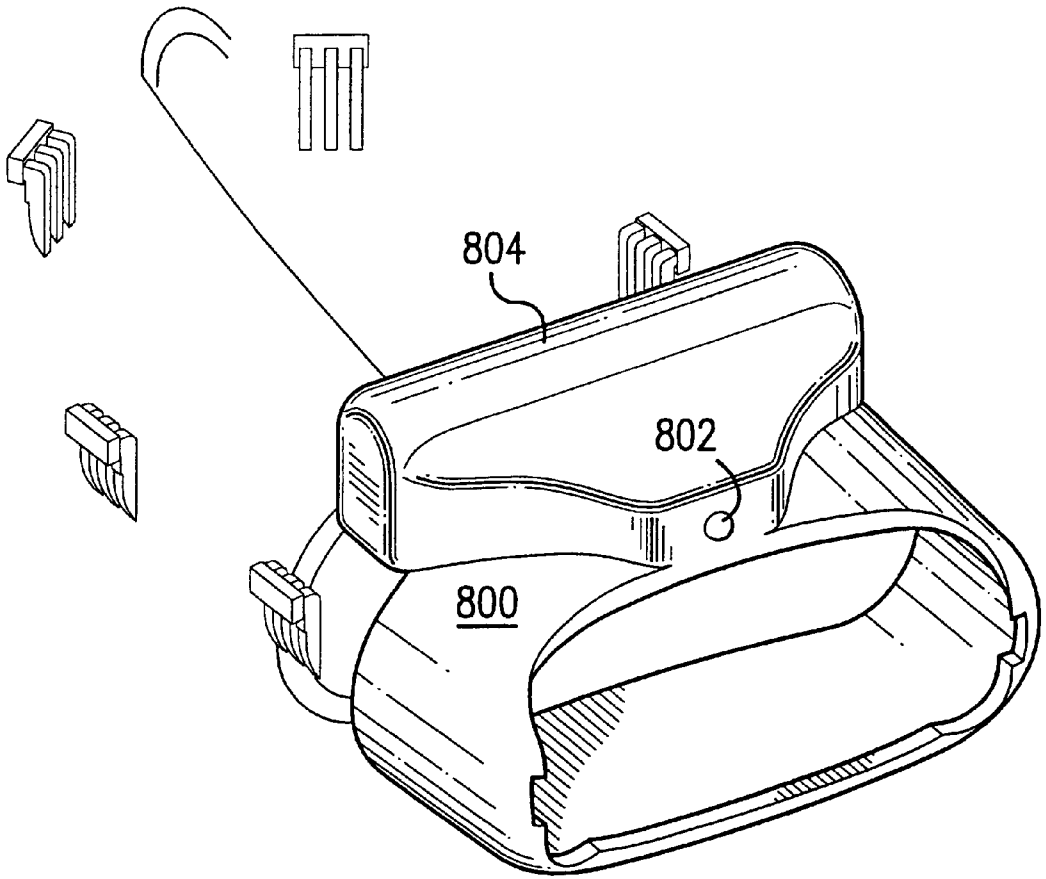
FIG. 17 is a perspective view of the illumination mechanism attached to a hair removal device.
Figure 18:
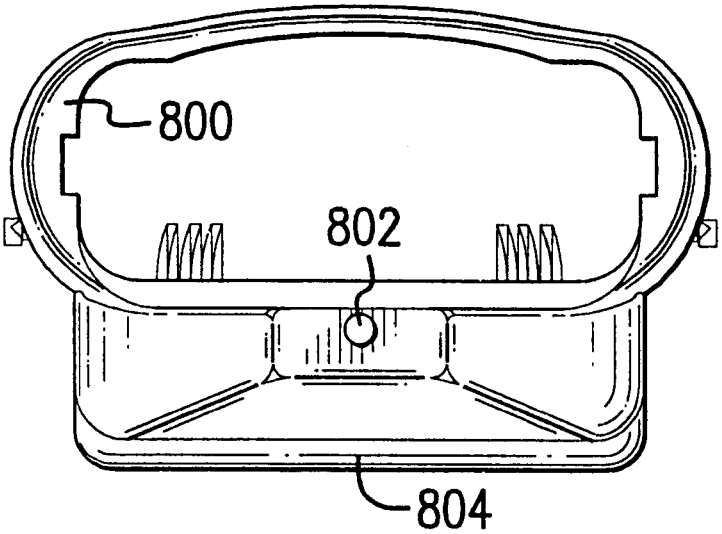
FIG. 18 is a top view of the illumination mechanism attached to a hair removal device.

Disc assemblies 500 in hair removal device 10 as described above rotate in the same direction (either all clockwise or all counterclockwise). In an alternative embodiment, the device may be modified so that disc assemblies 500 can rotate in opposite directions. Such an alternative embodiment uses a modified gear system illustrated in FIGS. 13 and 14. As shown in FIGS. 13 and 14, the modified gear system of hair removal device 20 includes an extra gear 221 and a smaller vibration gear 308 and eccentric cylinder 701 to accommodate the additional gear 221.

In operation, transmission gear 206 drives gear 221, which, in turn, drives one of the disc drive gears 220 as well as vibration gear 308. Vibration gear 308 then drives the other disc drive gear 220 and vibration beam 217. By using separate gears (gear 221 and vibration gear 308) to drive each disc drive gears 220 separately, disc drive gears 220 are able to rotate in opposite directions, resulting in disc assemblies 500 mounted in one row rotating in an opposite direction to disc assemblies 500 mounted in another row. Preferably, each row of disc assemblies 500 rotates away from each other so that the removed hairs are directed away from hair removal device 20 and skin in the area of hair removal is stretched to reduce discomfort associated with hair removal.

For both hair remover embodiments 10 and 20 described above as well as the hair remover device described in related patent U.S. Pat. No. 5,976,157, an illumination mechanism for illuminating the area of hair removal may be added, making it easier for a user to see the progress of hair removal. A preferred embodiment of illumination mechanism 800 is depicted in FIGS. 15–18.

Illumination mechanism 800 is preferably located near disc assemblies 500, (see, e.g. FIG. 1 and 2), so that it is close to the hair removal area. Preferably, light source 802 for illumination mechanism 800 is an incandescent light bulb or a light-emitting diode and is preferably oriented at an angle so as to maximize light directed to the hair removal area. In addition, illumination mechanism 800 may include a battery for powering light source 802. The battery may be contained in battery housing 804 built into illumination mechanism 800. In an alternative embodiment, illumination mechanism 800 may draw power from the hair remover itself so that a separate battery solely for powering illumination mechanism 800 is not required. Illumination mechanism 800 may also be a self-contained unit that can be attached or detached from the hair remover.

It should be noted that the disclosed embodiments can be modified by a person skilled in the art without deviating from the scope of the present invention. For example, the orientation of hair-plucking assembly 14 in relation to housing 17 may be varied in any number of alternative configurations to optimize efficiency and convenience of use. Examples of suitable alternative configurations are described in the above-mentioned Dolev patent, incorporated herein by reference in its entirety. In addition, there can be any number of rows of disc assemblies 500 in hair remover 10 or hair remover 20.

While the invention has been described in conjunction with specific embodiments, it is evident that numerous alternatives, modifications, and variations will be apparent to those skilled in the art in light of the forgoing descriptions. The scope of this invention is defined only by the following claims.

What is claimed is:

1. A hair removal device comprising:

(a) a housing;

(b) a hair-plucking assembly having at least two groups of disc assemblies arranged in at least two rows and mounted within said housing, wherein said disc assemblies arranged in one row rotate in an opposite direction to disc assemblies arranged in another row.

2. The hair removal device of claim 1, further comprising an illumination mechanism that illuminates area of hair removal.

3. The hair removal device of claim 2, wherein said illumination mechanism comprises a light source.

4. The hair removal device of claim 3, wherein said light source is an incandescent light bulb.

5. The hair removal device of claim 3, wherein said light source is a light-emitting diode.

6. The hair removal device of claim 3, wherein said light source is located close to the hair-plucking assembly so as to better illuminate the area of hair removal.

7. The hair removal device of claim 3, wherein said light source is oriented at an angle to better direct light to the area of hair removal.

8. The hair removal device of claim 2, wherein said illumination mechanism further comprises a battery housing that houses a battery for supplying power to said illumination mechanism.

9. The hair removal device of claim 2, wherein said illumination mechanism draws power from said hair removal device that powers said illumination mechanism.

10. The hair removal device of claim 2, wherein said illumination mechanism is detachable from said hair removal device.

11. A hair removal device comprising:

(a) a housing;

(b) a hair-plucking assembly having at least two groups of disc assemblies mounted within said housing arranged in at least two rows, wherein said disc assemblies arranged in one row rotate in an opposite direction to disc assemblies arranged in another row; and (c) a vibration assembly mounted within said housing.

12. The hair removal device of claim I 1, further comprising an illumination mechanism.

13. The hair removal device of claim 12, wherein said illumination mechanism comprises a light source.

14. The hair removal device of claim 13, wherein said light source is an incandescent light bulb.

15. The hair removal device of claim 13, wherein said light source is a light-emitting diode.

16. The hair removal device of claim 13, wherein said light source is located close to the hair-plucking assembly so as to better illuminate the area of hair removal.

17. The hair removal device of claim 13, wherein said light source is oriented at an angle to better direct light to the area of hair removal.

18. The hair removal device of claim 12, wherein said illumination mechanism further comprises a battery housing that houses a battery for suppling power to said illumination mechanism.

19. The hair removal device of claim 12, wherein said illumination mechanism draws power from said hair removal device that powers said illumination mechanism.

20. The hair removal device of claim 12, wherein said illumination mechanism is detachable from said hair removal device.

* * * * *